US005660286A

United States Patent [19]

Shea

[11] Patent Number: 5,660,286

[45] Date of Patent: Aug. 26, 1997

[54] MERCHANDISING DISPLAY STRUCTURE

[76] Inventor: Thomas M. Shea, 1435 Rivona, Waterford, Mich. 48328

[21] Appl. No.: 599,407

[22] Filed: Nov. 26, 1995

[51] Int. Cl.[6] ..... A47F 5/08

[52] U.S. Cl. ..... 211/87.01; 211/189; 248/220.41; 248/220.43

[58] Field of Search ..... 211/87, 59.1, 103, 211/189, 175; 248/220.21, 220.31, 220.41, 220.42, 218.4, 219.3

[56] References Cited

U.S. PATENT DOCUMENTS

| | | | |
|---|---|---|---|
| 431,110 | 7/1890 | Driver | 211/57.1 X |
| 2,020,991 | 11/1935 | Brody | 211/87 X |
| 2,935,210 | 5/1960 | Cohen | 211/187 X |
| 3,018,898 | 1/1962 | Frazelle | 248/220.43 X |
| 3,087,624 | 4/1963 | Hucker | 211/87 |
| 3,125,042 | 3/1964 | Mapson | 108/135 |
| 3,191,776 | 6/1965 | Tokash | 211/55 |
| 3,221,893 | 12/1965 | Glaberson et al. | 211/103 X |
| 3,285,208 | 11/1966 | Cohen | 108/146 |
| 3,513,606 | 5/1970 | Jones | 211/189 X |
| 3,586,284 | 6/1971 | Riebold | 248/316 R |
| 3,677,415 | 7/1972 | Radek | 211/59 |
| 3,743,105 | 7/1973 | David | 211/153 |
| 4,159,814 | 7/1979 | Fibus | 248/220.21 X |
| 4,171,052 | 10/1979 | Winn | 211/162 |
| 4,720,016 | 1/1988 | Kay | 211/103 X |
| 4,919,280 | 4/1990 | Phillips | 211/87 |
| 5,014,954 | 5/1991 | Merl | 248/285 |
| 5,090,725 | 2/1992 | Feldner | 211/189 X |
| 5,303,830 | 4/1994 | Metcalf | 211/57.1 |
| 5,443,167 | 8/1995 | Menaged et al. | 211/87 |
| 5,505,318 | 4/1996 | Goff | 211/90 |
| 5,556,064 | 9/1996 | Cowe | 211/175 |

*Primary Examiner*—Leslie A. Braun
*Assistant Examiner*—Sandra Snapp
*Attorney, Agent, or Firm*—Gifford, Krass, Groh, Sprinkle, Patmore, Anderson & Citkowski, P.C.

[57] ABSTRACT

A merchandising display assembly mounted to a vertical support surface, the support surface having a number of apertures formed therethrough. At least one horizontally extending member is mounted to and extends from the support surface. The horizontally extending member includes first and second elongated portions and axially adjusting means for establishing a length between the elongated portions. An elongated display member is secured to an outer end of the at least horizontal member and extends in parallel fashion relative to the vertical support surface at a spaced distance. The axially adjusting means permit the display member to be adjusted to a desired spaced position relative to the vertical support surface and the display member is capable of supporting large volumes of small sized merchandise without obscuring additional merchandise located on the vertical support surface.

15 Claims, 3 Drawing Sheets

MERCHANDISING DISPLAY STRUCTURE

BACKGROUND OF THE INVENTION

1. Field of the Invention

The present invention relates generally to merchandising display assemblies and, more particularly, to a merchandising display structure which is securable to a vertical support surface and which includes an elongated display member attached to one or more horizontally extending members and being spaced a distance from the vertical support, the display member being capable of supporting volumes of smaller sized merchandise.

2. Description of the Prior Art

Shelving structures and related display units for displaying merchandise are a common sight in any type of store or commercial establishment. The desire of any merchant is and always has been to maximize the available shelf or display capacity within the limited confines of the store. Vertically extending pegboard surfaces are particularly effective for displaying small, high volume merchandise on hooks and other horizontally extending fasteners.

U.S. Pat. No. 3,677,415, issued to Radek, teaches a cantilever merchandise support including an article supporting hanger bar or bracket which is adapted to be attached to a perforated board or panel by a plurality of legs extending from a mounting plate. The hanger bar or bracket portion is in each instance an integrally formed single piece which is mounted to extend outwardly from the vertical surface and upon which the merchandise is supported. The disadvantage of cantilevered merchandise supports such as those taught by Radek is that their merchandise carrying capacity is limited to the bar or bracket portion. The axial length which such supports extend is likewise limited such that they are unable to utilize to any great extent the air space extending from the pegboard or other surface for displaying merchandise.

U.S. Pat. No. 5,014,954, issued to Merl, discloses an adjustable display arm assembly securable to a vertical support structure which includes a pair of nesting segments selectively adjustable at longitudinal positions to establish an overall length of the display arm. The Merl device is somewhat of an improvement over Radek in that the display arm can be extended outward a greater horizontal distance, however its merchandise carrying ability is still limited to the display arm itself and it does not include any additional bracketry for carrying large volumes of merchandise.

SUMMARY OF THE PRESENT INVENTION

The present invention is a merchandising display assembly which may be mounted to a vertical support surface, the support surface being in the preferred embodiment a conventional pegboard surface having a number of apertures formed therethrough. At least one horizontally extending arm is provided and includes first and second elongated portions which are axially adjustable to modify the overall length of the arm. A planar support portion is attached to a free end of the first elongated portion and includes projecting finger portions which engage within the apertures in the pegboard surface to mount the arm in a horizontally extending fashion relative the vertical surface.

An elongated display member is attached to a free end of the at least one second elongated portion and extends parallel and at a spaced distance from the vertical support surface. A plurality of apertures are formed along the length of the display member at spaced apart intervals which are designed to receive hooks or other conventional hangers for supporting large volumes of small sized packaged merchandise. The advantage of the display member is that it can support a relatively large volume of small, high volume merchandise a spaced distance from the pegboard or other vertical surface without obscuring other additional items displayed on the vertical board or shelf surface. The overall advantage of the present invention is that it greatly increases the merchandise display capacity of such a conventional display structure by utilizing to a much greater extent the unused air space in the area in front of the display surface.

In further preferred embodiments, a pair of horizontally extending members may be provided which are separately attached to and which extend in parallel fashion from the display surface. The members attach to a display member extending therebetween at corresponding outer ends. The display arm supported by two horizontal members may be longer in length to accommodate additional product and may be arranged to extend in either a horizontal or vertical fashion as desired. The display arm may also be formed as two or more telescoping portions to either reduce or increase its overall length and a spring clip fastener may likewise be utilized with apertures formed in the sections to establish a given display arm length.

BRIEF DESCRIPTION OF THE DRAWING

Reference will now be made to the attached drawing, when read in combination with the following description of the preferred embodiments, wherein like reference numerals refer to like parts throughout the several views and in which.

DETAILED DESCRIPTION OF THE PREFERRED EMBODIMENTS

Figure 1:
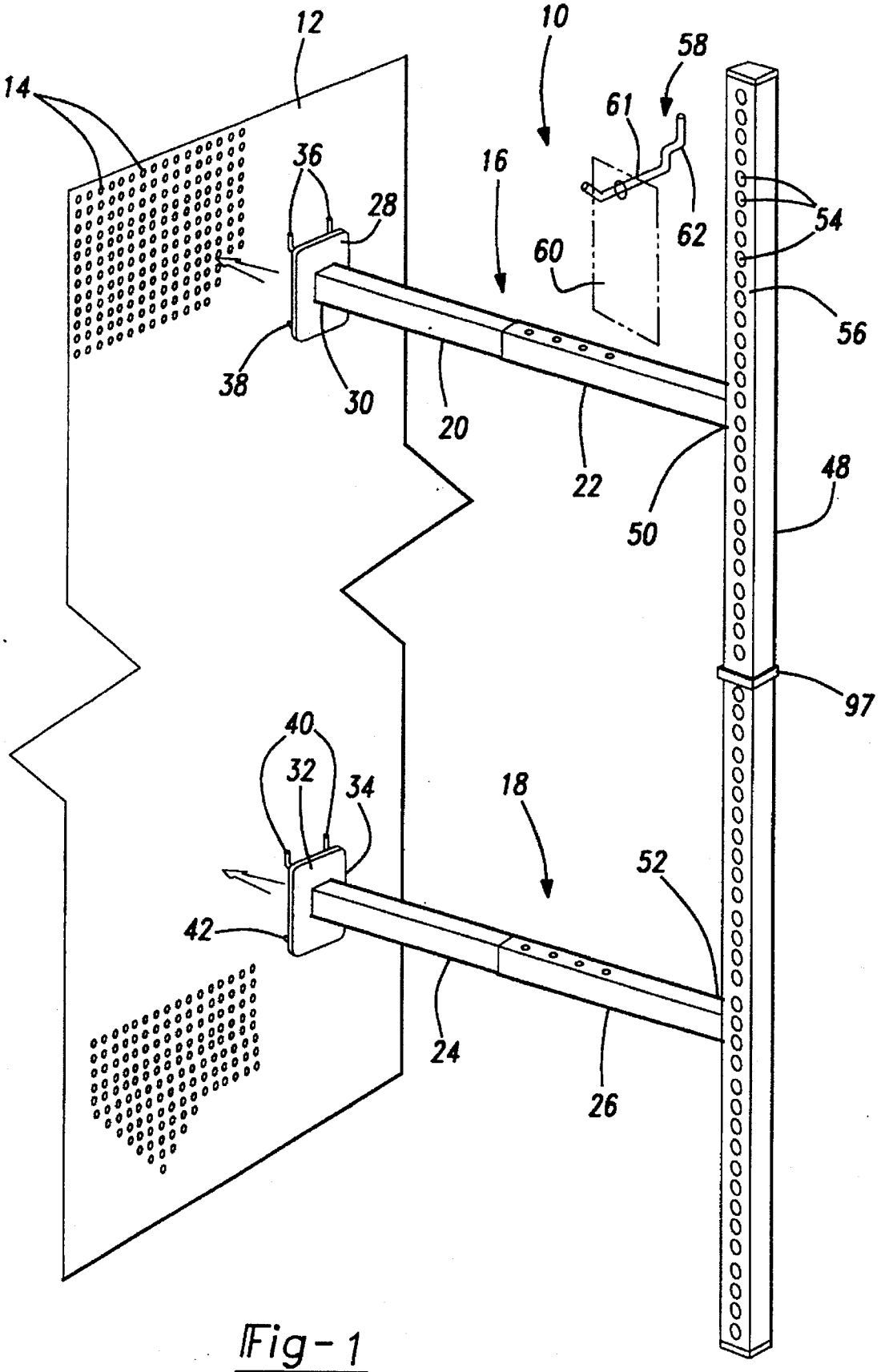
FIG. 1 is a perspective view of a merchandising display assembly according to a first preferred embodiment of the present invention.

Referring now to FIG. 1, a merchandising display assembly 10 is shown mounted to a vertical support surface 12 having a number of apertures 14 according to a first preferred. The vertical support surface is typically a holed pegboard type surface upon which volumes of small merchandise are displayed using hooks or hangers but can also be provided by any other surface such as a vertical face of a horizontal shelving support or the face of a vertically extending support of such a shelving support. The advantages of utilizing the merchandising display assembly according to the present invention with the various kinds of conventional shelving displays will be subsequently described.

Referring again to FIG. 1, the merchandising display assembly 10 includes a first horizontally extending member 16 and a second horizontally extending member 18. The first extending member 16 extends from the vertical support surface at a first location and includes a first elongated portion 20 and a second elongated portion 22. The second extending member 18 extends from the vertical support surface at a second location and likewise includes a first elongated portion 24 and a second elongated portion 26. A support portion 28 in the shape of a planar member is connected to a free end 30 of the elongated portion 20, preferably by welding, and a likewise shaped support portion 32 is connected to a free end 34 of the first elongated portion 24, the support portions 28 and 32 both being positioned in proximity to the apertures 14 of the vertical support surface 12.

Referring again to FIG. 1, the support portions 28 and 32 each further include pluralities of projecting fingers for mounting the display assembly to the vertical surface. Specifically, the support portion 28 includes a first pair of L-shaped engaging fingers 36 extending successively rearwardly and upwardly from an upper edge along a rear surface of the support portion 28 and a second pair of rearwardly projecting fingers 38 (only one of which is visible from FIG. 1) extending from a corresponding lower edge along the rear surface. The support portion 32 likewise includes a first pair of L-shaped engaging fingers 40 and a second pair of rearwardly projecting fingers 42.

Each of the support portions are capable of quickly and effectively mounting the display assembly to the vertical support surface by inserting upwardly projecting ends of the pairs of L-shaped fingers 36 and 40 into first pairs of the apertures 14 and then rotating the support portions downwardly so that the L-shaped fingers fixedly engage the vertical support surface and the lower pairs of projecting fingers 38 and 42 are likewise received within additional apertures. The support portions are releasably mounted in place once the associated apertures in the vertical support surface are engaged by the upper and lower pairs of extending fingers and the planar face of the support portion is rotated so that it lies flush against the face of the support surface.

Figure 2:
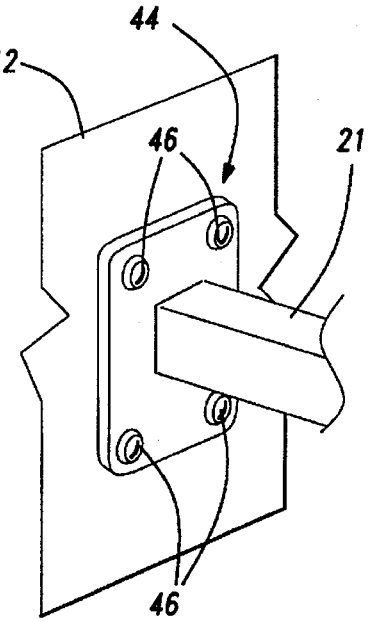
FIG. 2 is a sectional view of a support portion according to the preferred embodiment and showing an alternative variant for attaching the support portion to the vertical support surface.

In the case of two horizontally extending members, as are shown in the variant of FIG. 1, it is understood that one of the pairs of elongated portions would have to be disassembled and subsequently reassembled in order to mount the second of the support portions at a position relative to the first of the support portions. Alternatively, a planar shaped support portion 44, shown in FIG. 2, can replace the support portion 28 shown in FIG. 1 and is attached to a free end of a telescoping portion 21. A plurality of holes 46 are formed in the four corners of the planar shaped support portion 44 and are positioned over corresponding holes (not shown) in the vertical surface 12. Nut and bolt fasteners or screws (also not shown) may be provided for mounting the display assembly at the desired location along the support surface.

Referring again to FIG. 1, the first and second horizontally extending members 16 and 18 are preferably constructed of a durable metal or polymer with hollow tubular shaped members which are polygonal shaped in cross section and are specifically rectangular shaped in cross section. An elongated display member 48 is likewise constructed of a durable metal or polymer and is preferably of a similar shape and cross section to the first and second horizontally extending members and is secured to a free end 50 of the elongated portion 22 and a free end 52 of the elongated portion 26 so that the display member 48 extends in a spaced apart and parallel fashion with respect to the vertical support surface. A large plurality of apertures 54 are formed at small increments along a face 56 of the display member 48 and are each capable of receiving thereupon an appropriately configured hanger 58. Volumes of smaller sized items of merchandise 60 may be suspended from a laterally outwardly extending stem 61 of each of the hanger portions 58 once an attaching portion 62 has been engaged through a selected aperture 54. Preferably, an additional plurality of apertures are formed along a face opposite the face 56 of the display member (not shown) and are capable of supporting additional volumes of merchandise 60 in a spaced and parallel fashion relative to the vertical support surface.

Figure 3:
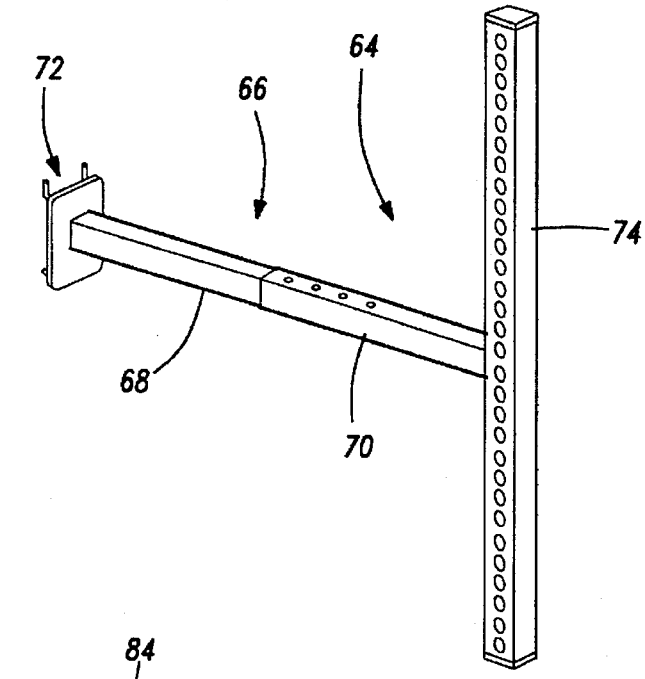
FIG. 3 is a perspective view of a merchandising display assembly according to a further variant of the first preferred embodiment of the present invention.

Referring to FIG. 3, a further variant 64 of the merchandising display assembly is shown and includes a single horizontally elongated member 66 having first and second elongated portions 68 and 70, a support portion 72 attached to a free end of the elongated portion 68 and an elongated display member 74 attached to a free end of the elongated portion 70. The construction of the merchandising display assembly 64 shown in FIG. 3 is identical in all respects with that shown in FIG. 1, with the exception that only one horizontally extending member is utilized and the elongated display member is accordingly shortened in length to account for the single engagement location with the end of the elongated portion 70.

Figure 4:
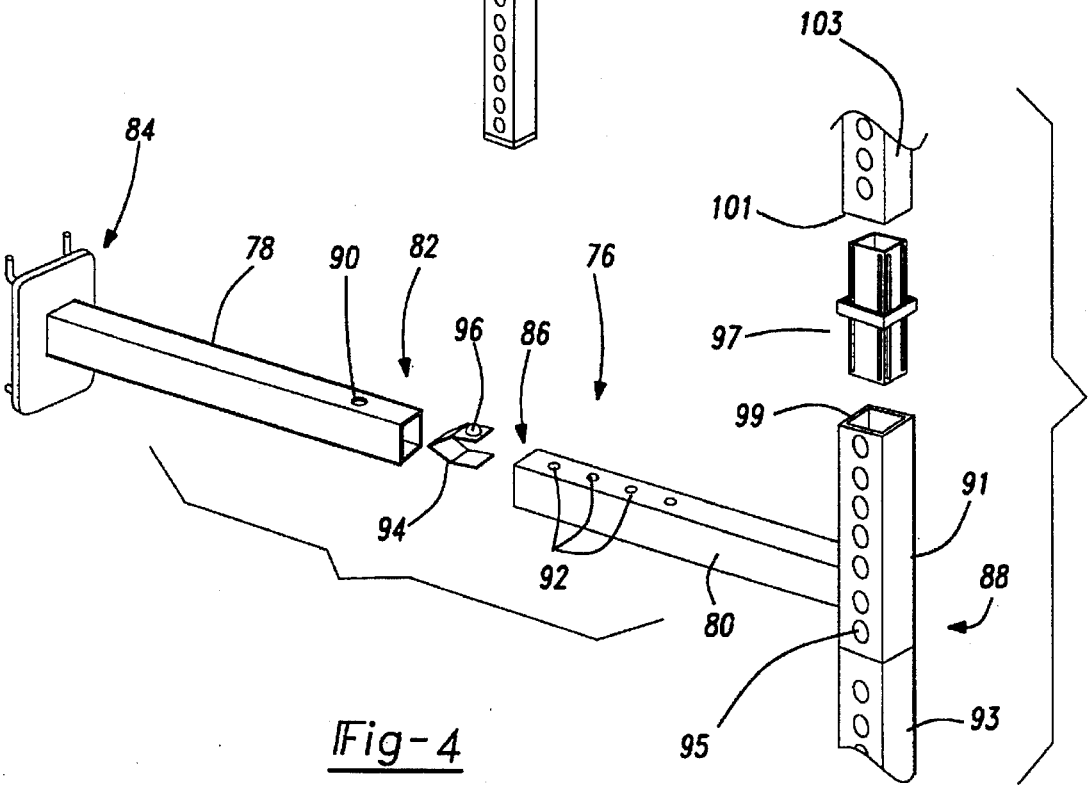
FIG. 4 is an exploded perspective view in section of the horizontally extending member according to either variant of the first preferred embodiment and illustrating the adjusting means for establishing an axial length of the horizontally extending member as well as the manner in which the support portion extends from the horizontal member according to the present invention.

Referring now to FIG. 4, an exploded view partially in section is shown 76 of a horizontally extending member according to either the variants of FIG. 1 or FIG. 3 in which the first elongated portion forms an inner telescoping portion 78 and the second elongated portion forms an outer telescoping portion 80. An end 82 of the inner telescoping portion 78 which is opposite to a support portion 84 is received within an end 86 of the outer telescoping portion which is opposite a display member 88. A single aperture 90 is formed along an upper face of the rectangular cross section of the inner telescoping portion 78 and is selectively and slidably aligned with one of a plurality of apertures 92 formed along an overlapping face of the outer telescoping portion 80. An outwardly biasing spring-loaded clip portion 94 is inserted within the end 82 of the inner telescoping portion so that an outwardly biasing button portion 96 projects through the single aperture 90 and one of the associated apertures 92 of the overlapping outer tubular portion. The overall length of the horizontal member may be adjusted simply by pressing the button portion 96 inwardly and then axially sliding the inner and outer telescoping members relative to one another until a desired aperture 92 of the plurality of apertures aligns over the single aperture 90, at which point the button portion will again project upwardly through the apertures snapping the horizontal member in place.

Referring again to FIG. 4, the display member 88 may likewise be formed of a first inner tubular portion 91 and a second outer tubular portion 93 with a spring actuated button portion 95 of a similar spring clip projecting through the apertures to define an established axial length. The purpose for the telescoping display member portions is to adjust an overall axial length to accommodate different volumes of display merchandise as needed. A connector 97 may also be provided for attaching an end 99 of the display member 88 of a first display assembly to an end 101 of a display member 103 of a second display assembly. In this manner, display members may be attached end to end to create a lengthened continuous display. The elongated display member 48 shown in FIG. 1 may also be telescoping, as shown by the phantom lines 97, with a first section forming an integral piece with the first horizontal member 20 and a second section forming an integral piece with the second horizontal member 22. A merchandising display assembly such as that shown in FIG. 1 would therefore be adjustable both axially in a direction along the length of the horizontally extending members and again crosswise along the length of the display member. It is also envisioned that the elongated display member may be constructed with the horizontally extending member or members and the support portions in such a fashion that it extends horizontally at a spaced distance from the vertical support surface as well as vertically as is shown in the drawings.

Figure 5:
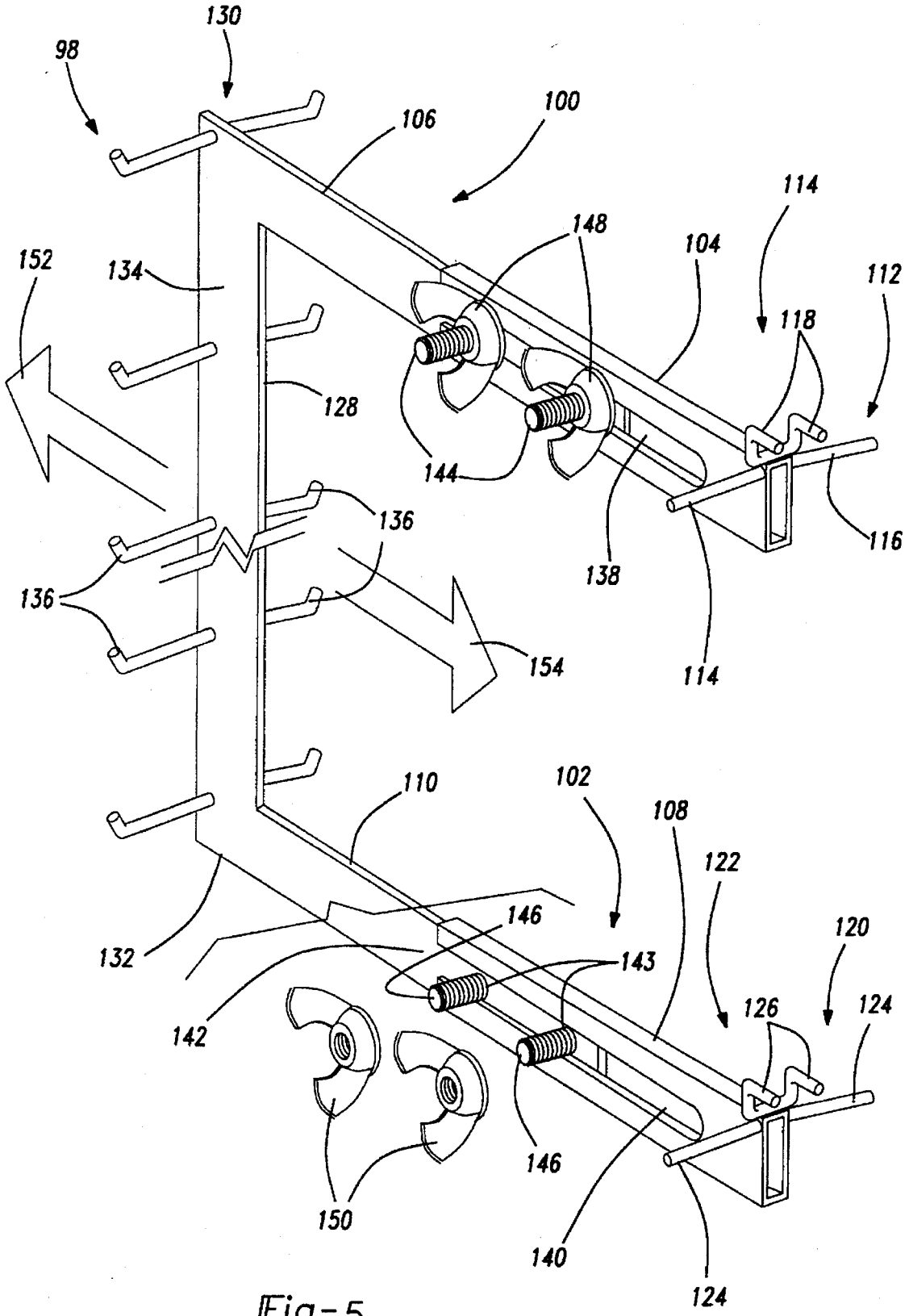
FIG. 5 is a perspective view of a merchandising display assembly according to a further preferred embodiment of the present invention.

Referring finally to FIG. 5, a merchandising display assembly 98 is shown for mounting to a vertically extending support surface according to a second preferred embodiment of the present invention. The display assembly 98 is similar in many respects to that described according to the first preferred embodiment and according to a preferred variant includes a first horizontally extending member 100 and a second horizontally extending member 102. The first and second extending members are elongated in shape and generally planar in cross section, with the first extending member 100 having a first elongated portion 104 and a second elongated portion 106 and the second extending member 102 having a first elongated portion 108 and a second elongated portion 110.

A first support portion 112 is attached to an end 114 of the elongated portion 104 and includes a pair of laterally extending support bars 116 and a pair of L-shaped engaging fingers 118. A second support portion 120 likewise is attached to an end 122 of the elongated portion 108 and also includes a pair of laterally extending support bars 124 and a pair of L-shaped engaging fingers 126. The pairs of engaging fingers 118 and 126 are received within apertures in the vertical support surface in a similar fashion to the pairs of engaging fingers 36 and 40 described in the first preferred embodiment and the pairs of laterally projecting bars abut against the vertical surface upon the support portions being rotated to a supporting position.

A display member 128 is connected to an end 130 of the first horizontally extending member 100 and an end 132 of the second horizontally extending member 102 and extends lengthwise therebetween. The display member 128 may alternatively be elongated to extend beyond the ends 130 and 132 to create a shape similar to that shown in FIG. 1. According to the second preferred embodiment, the display member 128 is planar shaped in cross section similar to both the first and second horizontally extending members and displays a face 134 and an opposite face which is hidden from view. Pluralities of hanger portions 136 extend laterally from both the face 134 and opposite face and upon these may be supported volumes of small packaged merchandise in the same manner as has been previously described.

The first and second horizontally extending members also includes axially adjusting means for spacing the display member at a desired and parallel distance from the vertically extending support surface. Specifically, an elongated slot 138 is formed along the axial length of the elongated portion 104 and an elongated slot 140 is likewise formed along the axial length of the elongated portion 108. The second elongated portions 106 and 110 according to the further preferred embodiment form a single piece with the crosswise extending display member and are secured respectively to internal channels formed by the slots in the respective first elongated portions 104 and 108. Specifically, the axially extending slotted portion 140 in the first elongated portion 108 is shown extending to an inner end 142 of the elongated portion 108 and slidably accepts the second elongated portion 110. Alternatively, the elongated slots may terminate short of the inner ends of the first elongated portions so that the second elongated portions may not be slidably withdrawn, however the horizontally extending members would still provide a considerably range of axial adjustment in a manner which will now be described.

A pair of apertures are formed through each of the second elongated portions 106 and 110 in proximity to the elongated slots. The aperture are located at 143 and are hidden from view but are clearly evidenced by first and second pairs of bolt fasteners 144 and 146 which insert respectively through the elongated portions 106 and 110. Pairs of wing nuts 148 and 150 rotatably engage the bolt fasteners 144 and 146 respectively and are selectively loosened and retightened to adjust an axially extending length of the display member 128 relative to the vertical support surface as defined by the direction of arrows 152 and 154.

The present invention therefore provides a merchandise display assembly which utilizes existing vertical shelving displays and the air space in front of the displays, such as a pegboard surface, for display significantly larger volumes of merchandise at little extra cost to the merchant.

It is understood that the preceding discussion cover only the most preferred embodiments of the merchandising display assembly according to the present invention and that other shapes and designs may also be employed. Specifically, more than two horizontally extending members may be employed with one or more vertically or horizontally extending display members. Other types of affixing means may also be utilized in the support portions for mounting them to the vertically extending surface. Finally, the merchandise display assembly according to the present invention is capable of being used with just about any vertically extending surface aside from a pegboard surface, such as a vertical face of a horizontal shelving unit or a vertically extending post having the appropriate apertures formed therein.

Having described my invention, other additional embodiments will become apparent to those skilled in the art to which it pertains according to the appended claims:

I claim:

1. A merchandising display assembly mounted to a vertical support surface, the support surface having a number of apertures formed therethrough, said display assembly comprising:

at least one horizontally extending member including a first elongated portion, a second elongated portion secured to said first elongated portion and adjusting means for axially spacing said second elongated portion relative to said first elongated portion, said first and said second elongated portions of said horizontally extending member each being substantially planar shaped in cross section;

a support portion attaching to a free end of said first elongated portion, said support portion including mounting means which engage through the apertures in the vertical support surface to mount said horizontally extending member in an extending fashion from the support surface; and an elongated display member attached to a free end of said second elongated portion and extending parallel and at a spaced distance from the vertical support surface, said display member including receiving means at spaced intervals along said display member for receiving a volume of merchandise.

2. The merchandising display assembly as described in claim 1, said first elongated portion further comprising an inner telescoping portion and said second elongated portion an outer telescoping portion, said inner telescoping portion being received within said outer telescoping portion and said outer telescoping portion projecting from an end of said inner telescoping portion opposite said support portion.

3. The merchandising display assembly as described in claim 2, said inner and outer telescoping portions each having a hollow interior and said axially adjusting means further comprising a plurality of spaced apart holes which are placed along said outer telescoping portion, a spring loaded pin projecting through a hole in said inner telescoping member and being selectively aligned with one of said plurality of holes in said outer telescoping portion to slidingly engage said inner tubular member with said outer tubular member.

4. The merchandising display assembly as described in claim 3, said inner and outer telescoping portions being polygonal shaped in cross section.

5. The merchandising display assembly as described in claim 4, said inner and outer telescoping portions being rectangular shaped in cross section.

6. The merchandising display assembly as described in claim 1, said axially adjusting means further comprising an elongated and axially extending slot formed through said first elongated portion, a pair of spaced apart holes being formed through said planar cross section of said second elongated portion and being positioned in alignment with said elongated slot, a pair of nut and bolt fasteners being received through said pair of spaced apart holes and said overlapping elongated slot to selectively engage said first and second elongated portions at a desired axial length.

7. The merchandising display assembly as described in claim 1, said support portion further comprising a planar shaped member welded to said free end of said first elongated portion.

8. The merchandising display assembly as described in claim 1, said elongated display member being polygonal shaped in cross section and further comprising a first telescoping section, a second telescoping section extending from said first telescoping section and axial spacing means for establishing an overall length of said display member.

9. The merchandising display assembly as described in claim 8, said display member comprising a first plurality of apertures in said first telescoping section and at least one second aperture in said second telescoping section which are in alignment with said first plurality of apertures, a second spring loaded pin being located within said second telescoping portion and projecting through said apertures to establish said display member at a given axial length.

10. The merchandising display assembly as described in claim 1, said at least one horizontally extending member further comprising a first horizontally extending member extending from a first position on the vertical support surface and a second horizontally extending member extending from a second position on the vertical support surface, said display member mounting to said free ends of said second extending portions and extending in a crosswise fashion therebetween.

11. The merchandising display assembly as described in claim 1, said receiving means comprising a plurality of apertures formed along said display member.

12. The merchandising display assembly as described in claim 1, said receiving means comprising a plurality of hanger portions formed along said display member.

13. The merchandising display assembly as described in claim 1, further comprising a connector for securing an end of an elongated display member of a first display assembly to an opposing end of an elongated display member of a second display assembly.

14. A merchandising display assembly mounted to a vertical support surface, the support surface being a pegboard surface having a number of apertures formed therethrough, said display assembly comprising:

at least one horizontally extending member including a first elongated portion, a second elongated portion secured to said first elongated portion and adjusting means for axially spacing said second elongated portion relative to said first elongated portion;

a support portion attaching to a free end of said first elongated portion, said support portion further including a planar shaped member welded to said free end of said first elongated portion, said support portion including mounting means which engage through the apertures in the vertical support surface to mount said horizontally extending member in an extending fashion from the support surface, said mounting means including a first pair of spaced apart and L-shaped engaging fingers extending from an upper edge of said planar shaped member, a second pair of spaced apart and rearwardly projecting fingers extending from a lower edge of said planar shaped member; and an elongated display member attached to a free end of said second elongated portion and extending parallel and at a spaced distance from the vertical support surface, said display member including receiving means at spaced intervals along said display member for receiving a volume of merchandise.

15. A merchandising display assembly mounted to a vertical support surface, the support surface having a number of apertures formed therethrough, said display assembly comprising:

at least one horizontally extending member including a first elongated portion, a second elongated portion secured to said first elongated portion and adjusting means for axially spacing said second elongated portion relative to said first elongated portion;

a support portion attaching to a free end of said first elongated portion, said support portion including mounting means which engage through the apertures in the vertical support surface to mount said horizontally extending member in an extending fashion from the support surface, said mounting means including a pair of laterally extending support bars welded to said free end of said first elongated portion and L-shaped engaging fingers extending from said support portion in proximity to said lateral support bars; and an elongated display member attached to a free end of said second elongated portion and extending parallel and at a spaced distance from the vertical support surface, said display member including receiving means at spaced intervals along said display member for receiving a volume of merchandise.

* * * * *